US009756941B1

(12) United States Patent
Rowland

(10) Patent No.: US 9,756,941 B1
(45) Date of Patent: Sep. 12, 2017

(54) CABINET SLIDE SYSTEM

(71) Applicant: Rev-A-Shelf Company, LLC, Louisville, KY (US)

(72) Inventor: Kenneth R. Rowland, Louisville, KY (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 0 days.

(21) Appl. No.: 15/064,327

(22) Filed: Mar. 8, 2016

(51) Int. Cl.
*A47B 88/04* (2006.01)
*A47B 88/12* (2006.01)

(52) U.S. Cl.
CPC ..... *A47B 88/12* (2013.01); *A47B 88/0418* (2013.01); *A47B 2210/0016* (2013.01); *A47B 2210/0056* (2013.01); *A47B 2210/0059* (2013.01)

(58) Field of Classification Search
CPC ... A47B 88/12; A47B 88/0418; A47B 88/423; A47B 2210/09; A47B 2210/0016; A47B 2210/0056; A47B 2210/0059
USPC ..... 312/330.1, 334.1, 334.6, 334.7, 334.8, 312/334.14, 334.27, 334.32
See application file for complete search history.

(56) References Cited

U.S. PATENT DOCUMENTS 4,285,560 A * 8/1981 Miller ..... A47B 88/493 108/83
4,465,324 A * 8/1984 Rock ..... A47B 88/487 312/334.39
4,824,158 A * 4/1989 Peters ..... B60R 5/04 108/44
5,641,216 A * 6/1997 Grass ..... A47B 88/483 312/330.1
6,142,596 A * 11/2000 Carson ..... A47B 88/487 312/330.1
6,491,331 B1 * 12/2002 Fox ..... B62D 33/0273 224/403
6,659,576 B1 * 12/2003 Welch ..... A47B 88/43 312/330.1
7,794,027 B2 * 9/2010 Calabria ..... A47B 77/10 312/311
7,810,890 B2 * 10/2010 Klein ..... A47B 88/90 312/330.1
(Continued)

FOREIGN PATENT DOCUMENTS

DE 19537739 A1 * 4/1997

*Primary Examiner* — James O Hansen
(74) *Attorney, Agent, or Firm* — Brinks Gilson & Lione

(57) ABSTRACT

A cabinet slide system includes a drawer or shelf and a telescoping slide member. The telescoping slide member can include a fixed base portion and a slidable portion. The slidable portion can be slidably engaged with the fixed base portion. The slidable portion can be coupled with the drawer or shelf so the combination of the drawer or shelf and the slidable portion is movable to extend away from the fixed base portion. The cabinet slide system can also include a rigid bracket and a support. The rigid bracket can be formed with a vertical section and a horizontal section perpendicular to the vertical section. The fixed base portion can be coupled with the vertical section. The support can be included in the horizontal section. The fixed base portion can be contiguously and detachedly rested on the support to arrest rotational torque of the telescoping slide member upon being placed under load.

21 Claims, 4 Drawing Sheets

(56) References Cited

U.S. PATENT DOCUMENTS

| | | | | |
|---|---|---|---|---|
| 2006/0001337 | A1* | 1/2006 | Walburn | A47B 88/42<br>312/334.27 |
| 2007/0024166 | A1* | 2/2007 | Sung | A47B 88/463<br>312/319.9 |

* cited by examiner

CABINET SLIDE SYSTEM

FIELD

The present disclosure relates generally to a cabinet slide system for use in a cabinet or other enclosure.

BACKGROUND

Cabinets such as storage cabinets for kitchens, bathrooms, closets, offices and other uses can include one or more receptacles, such as drawers or shelves for storing articles. The drawers and shelves can be designed to be moved between an open position and a closed position. While in the open position, a drawer or shelf may be extended away from the storage cabinet or other enclosure so as to receive the articles. In the closed position, the drawer or shelf may be recessed within the storage cabinet or other enclosure in which the drawer or shelve is installed. The size and weight of such drawers or shelves can vary. In addition, the weight and/or number of articles that can be stored on the drawers or shelves can be quite different in different applications.

SUMMARY

Further areas of applicability will become apparent from the description provided herein. It should be understood that the description and specific examples are intended for purposes of illustration only and are not intended to limit the scope of the present disclosure.

An example cabinet slide system can include a rigid bracket, a telescoping slide member, a drawer or shelf, and a support. The rigid bracket can be formed to include a planar coupling section and a planar support section. The planar support section can be formed to perpendicularly intersect the planar coupling section. The planar support section can be configured to be coupled with a floor of a cabinet. The telescoping slide member can be coupled with the planar coupling section so as to be fixedly held suspended away from the planar support section. The drawer or shelf can be fixedly coupled with a slidable portion of the telescoping slide member so that the drawer and the slidable portion are slidable away from a fixed base portion of the telescoping slide member. The support member included in the planar support section and configured to abut a fixed base portion of the telescoping slide member to maintain a carriage included in the fixed base portion substantially parallel to the support section.

Another example cabinet slide system can include a telescoping slide member. The telescoping slide member includes a frame integrally formed with a carriage and a slidable portion moveably coupled with the carriage. The frame can include a rigid planar structure. The cabinet slide system can also include a rigid bracket. The rigid bracket can include a horizontal section integrally formed with a vertical section. The horizontal section can be a planar member which includes a plurality of apertures to fixedly couple the horizontal section to a horizontal surface of an enclosure. The vertical section of the rigid bracket can be formed to extend perpendicularly away from the horizontal section. The frame can be contiguously coupled with the vertical section such that the carriage is spaced away and suspended above the horizontal section in a plane substantially parallel with the horizontal section. The cabinet slide system can also include a support included on the rigid bracket. The support can include a platform that is separated away from the horizontal section, and the carriage can be positioned in contiguous contact with the platform to support to constrain the carriage from twisting in response to a load placed on the slidable portion.

An interesting feature of the cabinet slide system is that the support includes a sidewall extending between the horizontal section and the platform to rigidly maintain the platform at a predetermined distance from the horizontal section. The support and the sidewall can be integrally formed with the horizontal section as a single unitary structure. In addition, a bottom surface of the carriage rests in contact with a top surface of the platform absent any attachment between the bottom surface and the top surface.

Another interesting feature of the cabinet slide system involves a rib included on the rigid bracket. The rib can extend from the horizontal section through a transition to the vertical section. The rib can be formed to provide rigidity to the rigid bracket to maintain the relative position of the vertical section extending perpendicularly to the horizontal section. The rib can include a slot formed to include a trench at a base of the slot, and beveled walls. The slot can be formed on a first planar surface of the horizontal section and also on the transition. The rib can also include a rail formed on a second planar surface of the horizontal section and on the transition. The first planar surface can be opposite the second planar surface such that a inward displacement to form the slot is equal to an outward displacement to form the rail.

Still another interesting feature of the cabinet slide system involves cooperative operation of the rigid frame and the telescoping slide member. A fixed base portion of the telescoping slide member includes a frame and a carriage. The frame is coupled with the vertical section of the rigid bracket so that the carriage is spaced away from the horizontal section of the rigid bracket, and the support extends above the horizontal section of the rigid bracket to be spaced away from a bottom surface of the carriage. The carriage can be configured to be contiguously supported by a support member included on the rigid bracket by contact between the bottom surface of the carriage and a top surface of the support member upon the telescoping slide member being placed under load.

Other systems, methods, features and advantages will be, or will become, apparent to one with skill in the art upon examination of the following figures and detailed description. It is intended that all such additional systems, methods, features and advantages be included within this description, be within the scope of the invention, and the following claims.

DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
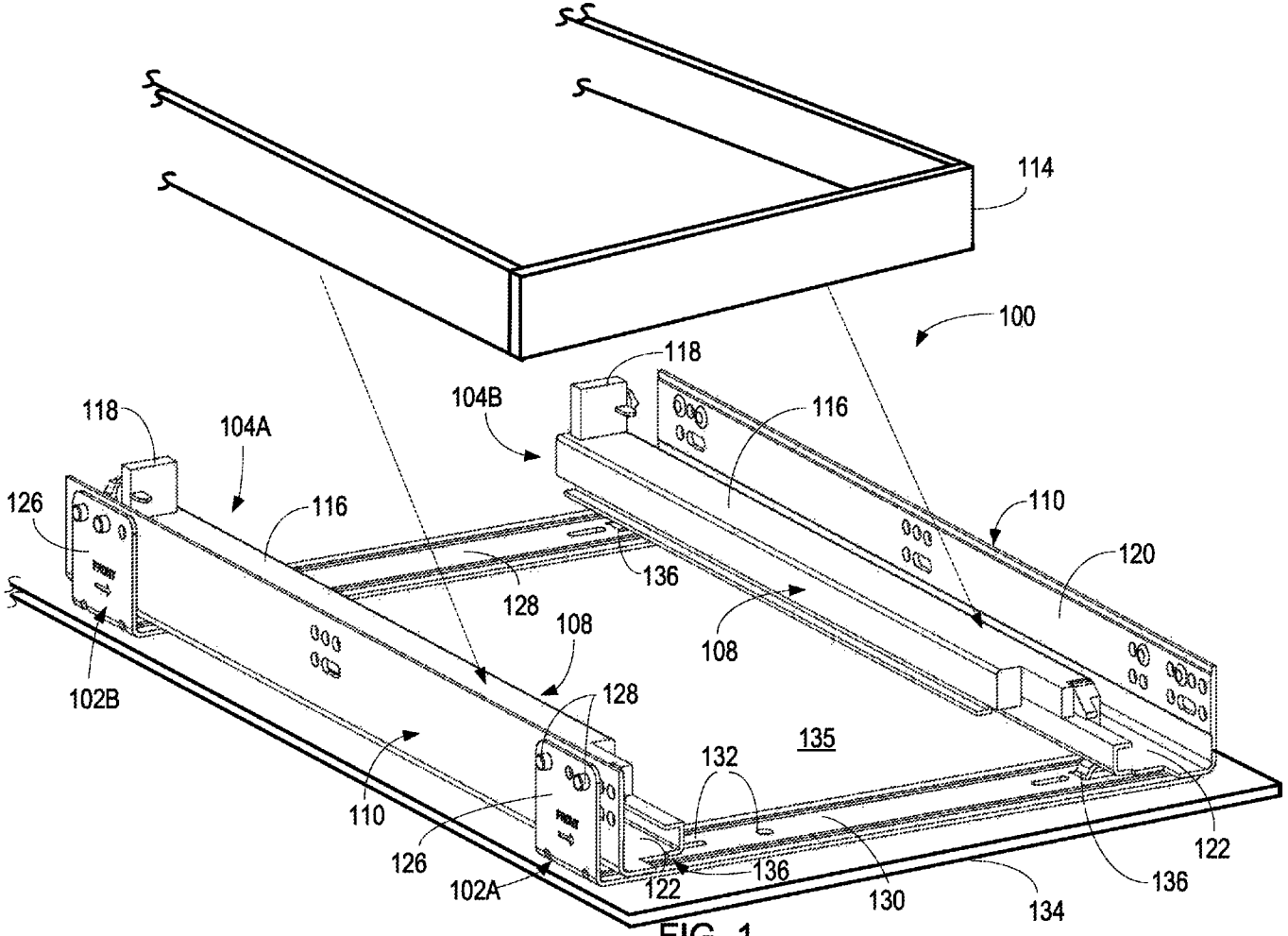
FIG. 1 is an exploded perspective view illustrating an example of a cabinet slide system, a receptacle, and an enclosure.

FIG. 1 is an example of a cabinet slide system 100. The cabinet slide system 100 includes brackets 102 and telescoping slide members 104. In the illustrated example, there is a front bracket 102A and a rear bracket 102B, however, in other examples, there can be one or more middle brackets positioned between the front bracket 102A and the rear bracket 102B. In addition, there is a right telescoping slide member 104A and a left telescoping slide member 104B illustrated.

The telescoping slide members 104A and 104B each include a slideable portion 108 and a fixed base portion 110. The slideable portion 108 is configured to be coupled with a receptacle 114, such as drawer or shelf, so that the slidable portion 108 and the receptacle 114 are movable together to be extended away from the fixed base portion 110. The receptacle 114 illustrated in FIG. 1 is an example in the form of a housing, such as a drawer, but is not meant to limit the form and/or shape of receptacles 114 that that can be used with the cabinet slide system 100. Accordingly, the receptacle 114 can be formed of any rigid material, such as a rigid planar material, for example wood, metal or plastic, or another form of rigid structure or semi-rigid material, such as wire or mesh, and can be formed in any shape, such as rectangular, square, oval, triangular, or any other one or more shapes.

In the illustrated example, the slideable portion 108 includes a planar receiving surface 116 and a latching system 118 such that the receptacle 114 can be received and aligned on the receiving surface 116 and be fixedly mounted on the slidable portion 108 with the latching system 118, as generally illustrated by dotted line arrows in FIG. 1. In other examples, any other form of fasteners may be used to removable or fixedly couple the slideable portion 108 to the receptacle 114. The receptacle 114 can be removably or fixedly coupled to the left telescoping slide member 104A and the right telescoping slide member 104B such that the left and right telescoping members 104A and 104B operate in tandem to reciprocate the receptacle 114 between a closed position where the left and right telescoping members 104A and 104B are retracted to be aligned to longitudinally extend along, adjacent to, and parallel with the fixed base portion 110, and an open position where the left and right telescoping members 104A and 104B, and the receptacle 114 are extended outwardly away from the fixed base portion 110.

The fixed base portion 110 includes a frame 120 and a carriage 122. In the illustrated example, the frame 120 and carriage 122 are formed as a single unitary structure such that the frame 120 resides in a vertical plane that is normal to a horizontal plane in which the carriage 122 resides. The carriage 122 is in contiguously contact and cooperatively operates with the slidable portion 108 to provide relatively low friction slidable movement, such as by using ball bearings, grooves, plastic and/or other mechanisms to enable slidable operation while rigidly maintaining the slidable portion 108 in a track formed by the carriage along which the slidable portion 108 can be reciprocated between an extended and a retracted position.

The frame 120 forms a rigid planar structure that extends between the brackets 102 and is fixedly coupled thereto. In an example, the frame 120 is integrally formed to receive a fastener such as a screw or rivet so as to be held contiguously against the brackets 102. The frame 120 is coupled with the brackets 102 such that the carriage 122 is cantilevered and carried by the brackets 102 since the carriage 122 is fixedly coupled perpendicular to the rigid planar surface of the frame 120. In this configuration, depending on the longitudinal position of the slidable portion 108, the carriage 122 may be subject to a rotational torque, with the axis of rotation being the point of coupling/contiguous alignment of the bracket 102 and the frame 120. For example, in the example of FIG. 1, when the slidable portion 108 is fully retracted, the front bracket 102A and the rear bracket 102B can be subject to a rotational torque that is substantially the same. Since the front bracket 102A and the rear bracket 102B can be subject to a rotational torque that is substantially the same the deformation of the carriage 122 is about the same in the vicinity of the front bracket 102A as in the vicinity of the rear bracket 102B. When the slidable portion 108 is extended however, the rear bracket 102B may be subject to significantly less rotational torque than the front bracket 102A such that the frame 120 can be subject to twisting. Such twisting can also occur in the carriage 122, which can impact the capability of the slidable portion 108 to slide smoothly without binding due to a track of the carriage 122, with which the slidable portion 108 is in contact, being compressed, expanded or otherwise warped or deformed by the difference in rotational torque.

The rigid bracket 102 includes a vertical section 126 formed as a planar member to be rigidly coupled with the frame 120 of the fixed base portion 104. In FIG. 1, the vertical section 126 is a planar coupling section of the rigid bracket 126 that is fixedly coupled in contiguous alignment with a planar surface of the frame 120 by fasteners 128, such as rivets, bolts, or pins. In other examples, the vertical section 126 and the frame 120 can be rigidly coupled by welding, snap-fit, or any other form of rigid coupling mechanism.

The rigid bracket 102 also includes a horizontal section 130 in the form of a planar support section that intersects with, and extends in a plane perpendicular to, the vertical section 126. The horizontal section 130 and the vertical section 126 can be formed as a single unitary structure of metal, plastic or other rigid material. The horizontal section 130 can be formed to include one more coupling apertures 132, which allow the rigid bracket 102 to be fixedly coupled to an enclosure 134, such as a cabinet, a shelf, a compartment, a housing or any other surface on which the cabinet slide system 100 can be mounted. An underside or planar bottom surface formed in the horizontal section 130 can be contiguously aligned in parallel with a floor 135 of the enclosure 134 and fixedly coupled thereto by fasteners, such as screws, rivets, adhesives, such as glue and/or any other coupling mechanism. In one example, the fasteners can extend through the coupling apertures 132 to fixedly engage the rigid bracket 102 and the floor 136. Thus, a planar bottom surface of the horizontal section 130 longitudinally extends upon a planar surface of the floor 135 of the enclosure 134. The enclosure 134 can be any size and shape, and the example enclosure 134 depicted in FIG. 1 is an illustrative example.

The horizontal section 130 also includes a support 136. The support 136 is fixedly positioned on the horizontal section 130 between a planar surface of the horizontal section and the carriage 122 so that the carriage 122 rests upon the support 136 when the vertical section 126 and the frame 120 are rigidly coupled. The frame 120 is coupled with the vertical section 126 to be spaced away from the horizontal section 130, and the support 136 extends above the horizontal section 130 to contiguously support the carriage 122 upon the telescoping slide member 104 being placed under load. The carriage 122 can contiguously and detachably rest on the support 136 to arrest rotational torque of the telescoping slide member 104, when the telescoping slide member 104 is placed under load, such as from weight being placed in the receptacle 114. Thus, the telescoping slide member 104 is constrained and supported from twisting due to a load when the slidable portion 108 is positioned in a fully extended position, a fully retracted position, or anywhere therebetween.

Accordingly, a planar surface of the carriage 122 is maintained in a predetermined substantially parallel relationship with the horizontal section 130 by the cooperative operation of the vertical section 126 and the support 136 to constrain the carriage 122 from twisting with respect to the frame 110. Also, the support 136 is spaced a predetermined distance above the rigid bracket 102 to allow the slidable portion 108 to fully extend over any lip or other vertically extending structure of the enclosure 134. For example, the enclosure 134 may be a cabinet having a front face trim that extends above the floor 135 of the cabinet a predetermined distance, such as 6.35 mm (0.25 inches), and the support 136 can maintain the slidable portion above a top edge of the front face trim.

Figure 2:
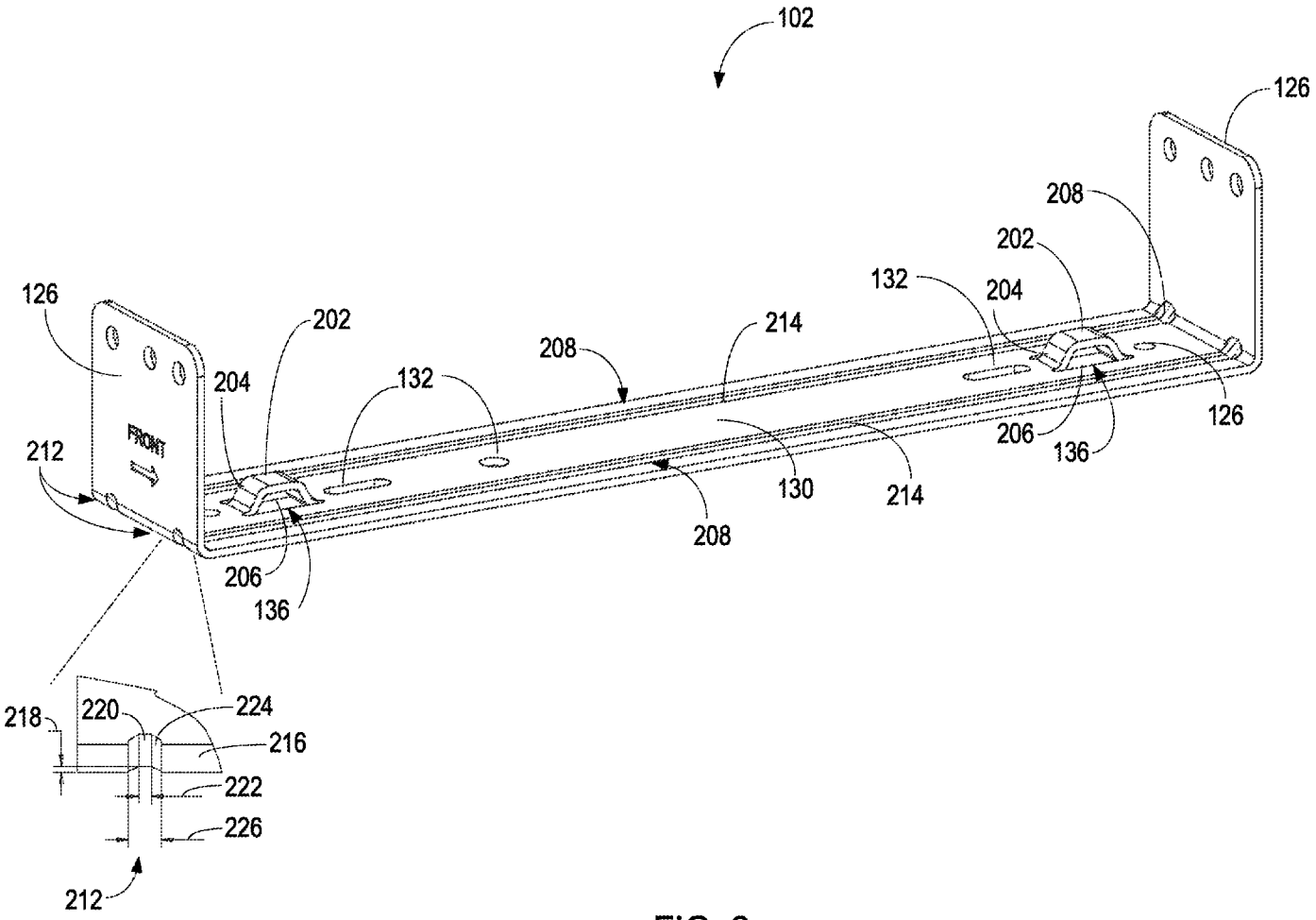
FIG. 2 is a perspective view of an example of a rigid bracket included in the cabinet slide system.

FIG. 2 is a perspective view of an example of a rigid bracket 102. The rigid bracket 102 includes a single unitary horizontal section 130 longitudinally extending between opposing vertical sections 126 such that the vertical sections 126 align with and establish a predetermined distance between left and right telescoping slide members 104A and 104B. The horizontal section 130 is formed with respective coupling apertures 132 and supports 136 positioned adjacent the opposing vertical sections 126 that are fixedly coupled at opposite ends of the horizontal section 130.

In other examples, the rigid bracket 102 can be separately formed as two rigid brackets 102 each with a separate horizontal section 130, which include the apertures 132 and supports 136. In these examples, the rigid brackets 102 can be positioned on the enclosure 134 in predetermined positions such that the horizontal sections 130 extend a predetermined distance toward each other, and the vertical sections 126 are opposing vertical sections 126. In this example configuration, the positioning of the rigid brackets 102 is adjustable with respect to each other to accommodate different widths of the receptacle 114.

The rigid bracket 102 can also include ribs 208. The ribs 208 can be included in both the vertical section 126 and the horizontal section 130 to act as stiffeners to maintain the perpendicular alignment of the planar coupling section (the vertical section 126) with respect to the planar support section (the horizontal section 130) and to rigidly maintain the planar coupling section and the planar support section 126 and 130 as flat surfaces. The ribs 208 can be formed as parallel structures extending along the planar surfaces of the horizontal section 130 and the vertical section 126. In FIG. 2, the ribs 208 can be formed by mechanically displacing a portion of the horizontal and vertical sections 130 and 126 to create parallel slots 212 on a bottom side of the horizontal section 130 and corresponding raised tracks 214 on the top planar surface of the horizontal section 130.

For example, a displacement force can be mechanically applied to a planar surface of the horizontal section 130 and the vertical section 126 to create the slots 212 and the corresponding tracks 214 can be created in the opposing surface by deforming the material from which the horizontal section 130 and the vertical section 126 are formed. In other examples, the ribs 208 can be rigid struts mechanically coupled to the horizontal and vertical sections 130 and 126, and/or can be formed as integral features within the material from which the horizontal and vertical sections 130 and 126 are formed.

The ribs 208 can continuously extend to the opposite ends of the horizontal section 130 where the vertical sections 126 are perpendicularly coupled. In addition, the ribs 208 can continuously extend through a transition from the horizontal section 130 to the vertical section 126. In the example of FIG. 2, where the vertical section 126 and the horizontal section 130 are a single unitary flat planar structure that is bent at a ninety degree angle, the ribs 208 maintain rigidity of the flat planar structures against warping and bending, and increase the rigidity of the bend by continuously extending through the transition.

FIG. 2 includes a close up view of an example of a part of the slot 212 of a rib 208 formed in a transition area within which the vertical section 126 transitions to the horizontal section 130. In FIG. 2, a portion of a planar surface 216 in the transition area is displaced by a predetermined amount, such as 0.8 mm (0.03 inches) as illustrated by arrows 218. Displacement can be performed by application of a mechanical force to the planar surfaces. The slot 212 is formed to include a trough at a base 220 of the slot 212. In an example, the base 220 can have a first predetermined slot width, such as 1.8 mm (0.07 inches), as illustrated by arrows 222. The slot 212 can also include opposing beveled walls 224 that widen the slot 212 at a mouth of the slot 212 to a second predetermined slot width, such as 4.6 mm (0.18 inches) as illustrated by arrows 226.

The supports 136 are each formed to include a raised platform 202 maintained in a fixed predetermined position above a planar surface of the horizontal section 130 by the side walls 204, and spaced away from the vertical sections 126 a predetermined distance. In the illustrated example, the supports 136 are integrally formed in the fixed predetermined position as part of the horizontal section 130. Formation of the supports 136 in the illustrated example may be by cutting a slot 206 in the horizontal section 130 and mechanically pressing the slot material away from the planar surface with sufficient force to create the platform 202 and the sidewalls 204. In other examples, the supports 132 can be separate platforms 202 having side walls 204, which can be fixedly coupled to the planar surface of the horizontal section 130 in the predetermined position by fasteners, such as welding, an adhesive, screws, or any other coupling mechanism. The supports 136 are formed with the platform 202 of a predetermined area and height above the horizontal section 130 to abut a fixed base portion of the telescoping slide member 104 in order to maintain the carriage 122 included in the fixed base portion 110 substantially parallel to the horizontal section 130 (support section).

In an example, the fixed base portion of the telescoping slide member 104 is suspended above the platform 202 such that the fixed base portion of the telescoping slide member 104 is spaced away from the platform 202. A predetermined distance between the platform 202 and the fixed base portion of the telescoping slide member 104 may form an air space therebetween. As a load, such as a drawer or shelf provides a downward force on the telescoping slide member 104, the telescoping slide member 104 may move into a position to be resting on the platform 202. Alternatively, the fixed base portion of the telescoping slide member 104 can be positioned to rest upon the platform 202.

Figure 3:
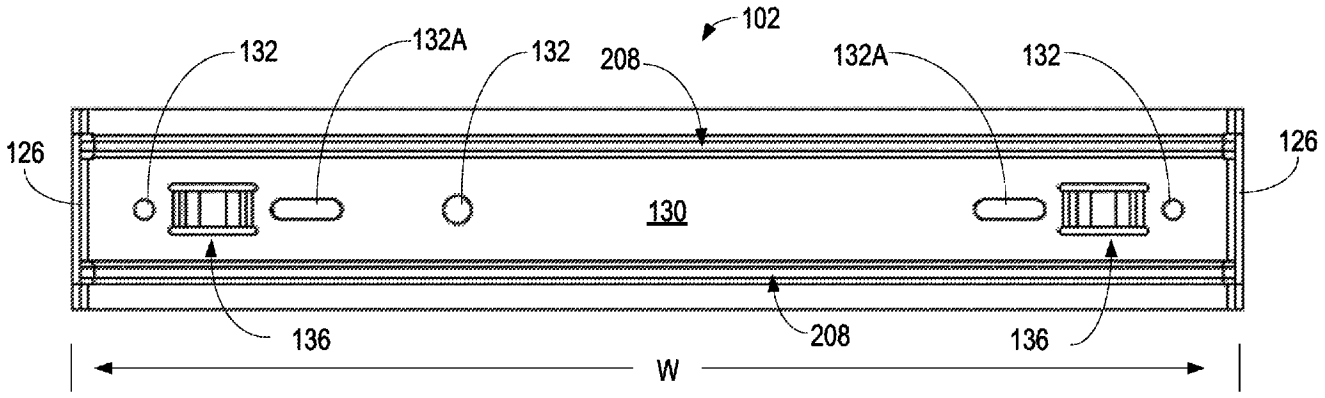
FIG. 3 is a plan view of an example of a rigid bracket included in the cabinet slide system.

FIG. 3 is an example of a top plan view of a rigid bracket 102 that includes the opposing vertical sections 126 coupled by a horizontal section 130. The horizontal section 130 includes the supports 136 and is formed to include coupling apertures 132. In FIG. 3, coupling apertures 132A are illustrated as slots to provide additional flexibility to the positioning of fasteners extending through the apertures 132A to fixedly engage the rigid bracket and a floor of an enclosure upon which the rigid bracket 102 is mounted. The apertures 132 are formed to be accessible even when the telescoping slide member 104 is coupled with the rigid bracket 102.

In an example enclosure that is a cabinet (not shown), the rigid bracket 102 can have a width (W) formed by the horizontal section 130 such that the opposing vertical sections 126 closely fit within vertical walls of the enclosure. In this application, fasteners can be applied from above the rigid bracket 102 to the slots 132A to fixedly fasten the rigid bracket 102 to a floor formed as a horizontal planar surface of the cabinet. Due to the slots 132A being inboard of the telescoping slide members 104, access to mount and fixedly couple the rigid brackets 102 anywhere along the floor of the enclosure is available. In addition, since the rigid brackets 102 include the supports 136, and the ribs 208 to minimize deformation, the positioning of the telescoping members 104 can be rigidly maintained without warping, twisting, or deformation even though the only coupling of the rigid bracket 102 is with the floor of the enclosure. In other words, because of the supports 136 and the ribs 208, coupling the rigid bracket 102 with only the floor of the enclosure provides rigid structural support to the telescoping slide member 104 that minimizes any twisting or warping of the carriage 122 and allows the slidable member 108 to move freely between the open and closed position even with a significant downward loading force being present.

Figure 4:
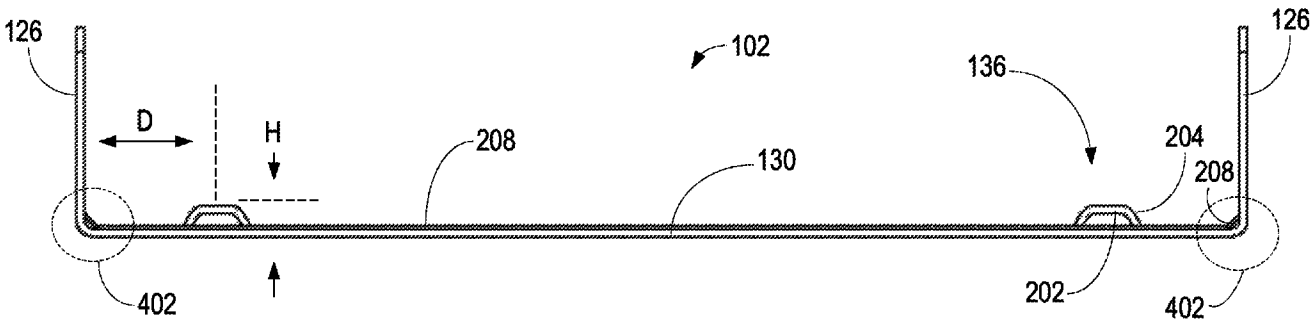
FIG. 4 is an elevation view of an example of a rigid bracket included in the cabinet slide system.

FIG. 4 is an example elevation view of a rigid bracket 102. The rigid bracket 102 of this example includes the opposing vertical sections 126 formed at the ends of a continuous longitudinally extending horizontal section 130. In other examples, as discussed elsewhere, a rigid bracket 102 may only include one vertical section 126. The horizontal section 130 includes the supports 136, which can be integrally formed or a separate member. The supports 136 can include the platform 202 and the sidewalls 204. The horizontal section 130 and a transition 402 to the vertical section 126 can also include integrally formed ribs 208 as illustrated.

The platform 202 is raised above the planar surface of the horizontal section 130 a predetermined height (H) to be aligned with a bottom surface of the carriage 122. In addition, the platform 202 can be positioned a predetermined distance (D) in a spaced relation from the vertical section 126 to align with a bottom surface of the carriage 122. Thus, when the telescoping slide member 104 is fixedly coupled with the vertical section 126, a bottom surface of the carriage 122 can rest in contiguous contact with a top surface of the platform 202. Alternatively, a bottom surface of the carriage 122 can be spaced a predetermined distance away from a top surface of the platform 202 such that the carriage 122 comes into contiguous contact and rests on the top surface of the platform 202 when the telescoping slide member 104 is subject to a load creating a downward force. The carriage 122 is therefore rigidly maintained in a flat planar configuration substantially parallel with the planar surface of the horizontal section 130 with various loading levels and while being selective slid between an extended and retracted position.

The vertical sections 126 are rigidly maintained normal to the horizontal section 130 at a ninety degree angle between the horizontal section 130 and the vertical sections 126 due to the ribs 208 in the transition areas 402 strengthening the rigidity of the intersection of the horizontal section 130 and the vertical section 126. In addition, any load experienced by the telescoping sliding members 104 is transferred to the vertical section 126 as a rotational torque that attempts to decrease the ninety degree angle by urging the vertical section 126 towards the horizontal section 130. The supports 136, however, arrest such movement, not only by stopping downward movement of the telescoping member 104, but also allowing the load experienced by the telescoping sliding members 104 to be distributed between the vertical section 126 and the supports 136.

Figure 5:
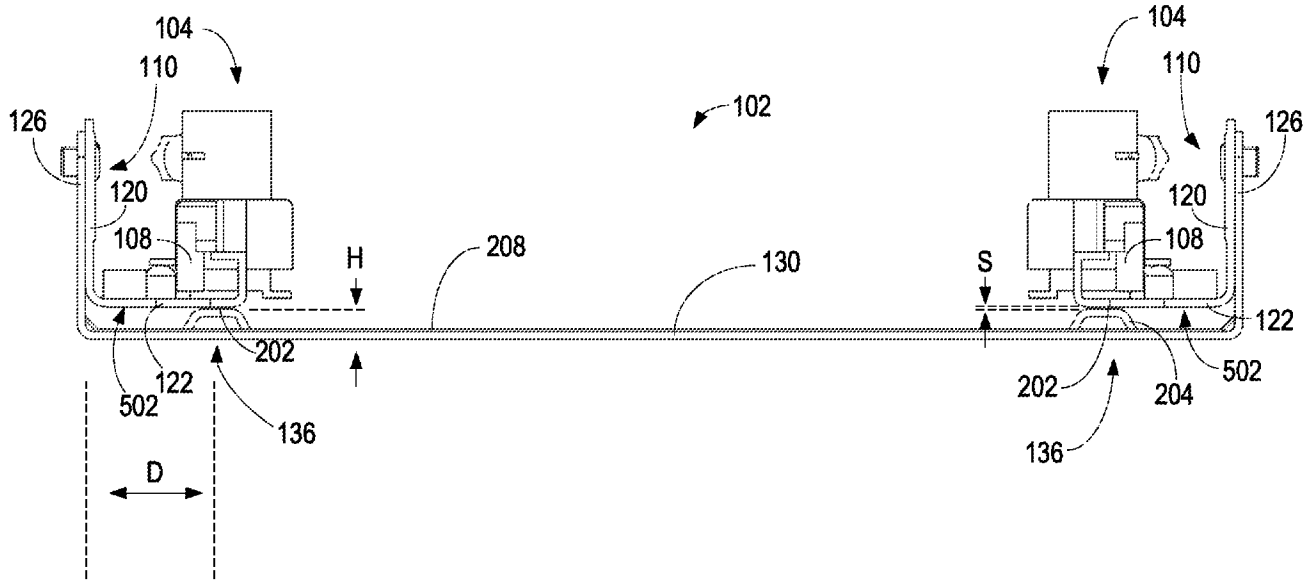
FIG. 5 is an elevation view of an example of a cabinet slide system.

FIG. 5 is an example elevation view of the rigid bracket 102 coupled with the telescoping sliding member 104. The fixed base portion 110 of the sliding member 104 includes the frame 120 and the carriage 122 upon which the slidable portion 108 slides to move a cabinet or drawer between an open and closed position. The horizontal section 130 includes the ribs 208 and the support members 136 which extend above the planar horizontal surface of the horizontal section 130 a predetermined height (H) to a platform 202. The platform 202 is spaced away from the vertical section 126 by predetermined distance (D). The vertical section 126 includes a first planar member, and the frame 120 includes a second planar member aligned in parallel and contiguously coupled such that a planar bottom surface 502 of the carriage 122 is maintained in a predetermined substantially parallel relationship with the horizontal section 130 of the rigid bracket 102 by cooperative operation of the vertical section 126 and the support 136 to constrain the carriage 122 from twisting or bending with respect to the frame 120 and/or the planar horizontal surface of the horizontal section 130.

The platform 202 of the support 136 can be spaced a predetermined distance (S) away from the planar surface 502 of the frame 120 so as to form an airspace therebetween. In an example, the distance (S) may be between about 0.35 mm (0.014 inches) and 0.40 mm (0.016 inches). In another example, the distance (S) may be about 0.5 mm (0.020 inches). Accordingly, a load placed on the sliding member 104 as a downward force, can move the planar surface 502 into contiguous contact with the platform 202 so that the sliding member 104 is contiguously and detachedly rested and rotational torque of the telescoping slide member 104 is arrested. In other examples, the planar surface 502 of the frame 120 can be positioned in contact with the top surface of the platform 202 such that a load placing a downward force on the sliding member 104 does not substantially move the planar surface 502 out of parallelism with the planar horizontal surface of the horizontal section 130.

As illustrated in FIG. 5, the planar surface 502 on the bottom of the carriage 122 is maintained in a substantially parallel relationship with the horizontal section 130 whether the planar surface 502 rests on the platform 202, or is spaced away from the top surface of the platform 202 by the predetermined distance (S). Accordingly, the planar surface 502 remains substantially parallel with the horizontal planar surface of the horizontal section 130 even with movement of up to +/−0.5 mm (0.020 inches) between being spaced away from the platform 202 by the distance (S) and resting on the platform 202. By the planar surface 502 being maintained in a substantially parallel relationship with the horizontal planar surface of the horizontal section 130, the slidable portion 108 is moveable along a receiving surface of the carriage 122 opposite the planar surface 502 without binding or otherwise constraining movement.

It is now apparent that there are many advantages of the cabinet slide system provided herein. In addition to the advantages that have been described, it is also possible that there are still other advantages that are not currently recognized but which may become apparent at a later time.

While preferred embodiments of the cabinet slide system have been described, it should be understood that the disclosure is not limiting, and modifications may be made without departing from the features and functionality described. The scope of the disclosure is defined by the appended claims, and all devices that come within the meaning of the claims, either literally or by equivalence, are intended to embrace them.

I claim:

1. A cabinet slide system comprising:

a drawer or shelf;

a telescoping slide member comprising a fixed base portion and a slidable portion slidably engaged with the fixed base portion, the slidable portion coupled with the drawer or shelf so a combination of the drawer or shelf and the slidable portion is movable to extend away from the fixed base portion;

a rigid bracket formed with a vertical section and a horizontal section perpendicular to the vertical section, the fixed base portion coupled with the vertical section so that the fixed base section is suspended away from the horizontal section of the rigid bracket; and a support included in the horizontal section, the support integrally formed by slot material from a slot formed in the horizontal section, the slot material being pressed away from the horizontal section to form the slot and a raised platform spaced away from the horizontal section by only two sidewalls integrally formed from the slot material at opposing ends of the slot, the fixed base portion being contiguously and detachedly rested on the raised platform to arrest rotational torque of the telescoping slide member upon being placed under load.

2. The cabinet slide system of claim 1, wherein the rigid bracket is a unitary single piece structure, and the support is formed as an integral part of the horizontal section, and the raised platform is raised above a planar horizontal surface of the horizontal section.

3. The cabinet slide system of claim 1, wherein the rigid bracket is a plurality of brackets comprising a front bracket and a rear bracket, and the fixed base portion extends rigidly between the front bracket and the rear bracket and is fixedly coupled thereto.

4. The cabinet slide system of claim 1, wherein the rigid bracket includes a left vertical section and a right vertical section fixedly coupled at opposite ends of the horizontal section such that the horizontal section longitudinally extends between the opposing left and right vertical sections, the horizontal section including a first support near the left vertical section upon which a first fixed base section of a first telescoping sliding member is supported, and a second support near the right vertical section upon which a second fixed base section of a second telescoping sliding member is supported.

5. The cabinet slide system of claim 4, wherein the horizontal section is formed to include a plurality of coupling apertures and a planar bottom surface formed to contiguously align with a floor of an enclosure such that the rigid bracket can be fixedly coupled to the floor of the enclosure via fasteners extending through the apertures to fixedly engage the rigid bracket and the floor.

6. The cabinet slide system of claim 1, wherein the fixed base portion comprises a frame and a carriage, and wherein the frame is coupled with the vertical section of the rigid bracket so that the carriage is spaced away from the horizontal section of the rigid bracket, and the support extends above the horizontal section of the rigid bracket to be spaced away from a bottom surface of the carriage, the carriage configured to be contiguously supported by the support by contact between the bottom surface of the carriage and the raised platform of the support upon the telescoping slide member being placed under load.

7. The cabinet slide system of claim 1, wherein the fixed base portion comprises a frame and a carriage, and wherein a planar surface of the carriage is maintained in a predetermined substantially parallel relationship with the horizontal section of the rigid bracket by cooperative operation of the vertical section and the support to constrain the carriage from twisting with respect to the frame.

8. The cabinet slide system of claim 1, wherein the support is formed to include a platform and sidewalls, the platform being a flat planar area of predetermined size that is rigidly held at a fixed predetermined distance above a planar surface of the horizontal section by the sidewalls, and spaced away a predetermined distance from the vertical section.

9. The cabinet slide system of claim 1, wherein the vertical section is a first planar member, and the fixed base portion includes a second planar member aligned in parallel with the vertical section.

10. A cabinet slide system comprising:

a rigid bracket formed to include a planar coupling section and a planar support section, the planar support section formed to perpendicularly intersect the planar coupling section and configured to couple with a floor of a cabinet;

a telescoping slide member coupled with the planar coupling section so as to be fixedly held suspended away from the planar support section;

a drawer or shelf fixedly coupled with a slidable portion of the telescoping slide member so that the drawer and the slidable portion are slidable away from a fixed base portion of the telescoping slide member; and a support member included in the planar support section and configured to abut a fixed base portion of the telescoping slide member to maintain a carriage included in the fixed base portion substantially parallel to the planar support section;

wherein the support member comprising a platform and a pair of sidewalls, the platform positioned by the pair of sidewalls over a slot forming an opening through the horizontal section, the pair of sidewalls positioned at opposite ends of the slot.

11. The cabinet slide system of claim 10, wherein the planar support section and a transition between the planar support section and the planar coupling section include a rib continuously extending along the planar support section and the planar coupling section.

12. The cabinet slide system of claim 11, wherein the rib is formed to continuously extend through the transition between the planar support section and the planar coupling section.

13. The cabinet slide system of claim 12, wherein the rib is integrally formed as a raised track on one surface of the planar support section and the planar coupling section, and as a corresponding slot integrally formed on an opposing surface of the planar support section and the planar coupling section by displacement of a portion of the planar support section and the planar coupling section.

14. The cabinet slide system of claim 10, wherein the fixed base portion includes a frame that is vertically aligned in parallel with the planar coupling section, the frame and the carriage formed as a single unitary structure such that the frame resides in a vertical plane that is normal to a horizontal plane in which the carriage resides.

15. A cabinet slide system comprising:

a telescoping slide member that includes a frame integrally formed with a carriage and a slidable portion moveably coupled with the carriage, the frame comprising a rigid planar structure;

a rigid bracket comprising a horizontal section integrally formed with a vertical section, the horizontal section being a planar member and including a plurality of apertures to fixedly couple the horizontal section to a horizontal surface of a cabinet, and the vertical section formed to extend perpendicularly away from the horizontal section;

the frame being contiguously coupled with the vertical section such that the carriage is spaced away and suspended above the horizontal section in a plane substantially parallel with the horizontal section; and a support included on the rigid bracket, the support comprising a platform that is separated away from the horizontal section by a sidewall, the sidewall spaced away from the vertical section and extending transverse to the horizontal section, and the carriage is positioned to contiguously contact the platform to support and constrain the carriage from twisting in response to a load placed on the slidable portion.

16. The cabinet slide system of claim 15 wherein the rigid bracket includes a rib extending from the horizontal section through a transition to the vertical section, the rib formed to provide rigidity to the rigid bracket to maintain a relative position of the vertical section extending perpendicularly to the horizontal section.

17. The cabinet slide system of claim 16, wherein the rib comprises a slot formed to include a trench at a base of the slot, and beveled walls, the slot formed on a first planar surface of the horizontal section and the transition, and a rail formed on a second planar surface of the horizontal section and the transition, the first planar surface being opposite the second planar surface such that an inward displacement to form the slot is equal to an outward displacement to form the rail.

18. The cabinet slide system of claim 15, wherein the support further comprises a sidewall extending between the horizontal section and the platform to rigidly maintain the platform at a predetermined distance from the horizontal section.

19. The cabinet slide system of claim 18, wherein the support and the sidewall are integrally formed with the horizontal section as a single unitary structure.

20. The cabinet slide system of claim 15, wherein a bottom surface of the carriage is arranged to contiguously contact a top surface of the platform absent any attachment between the bottom surface of the carriage and the top surface of the platform.

21. The cabinet slide system of claim 15, wherein the support extends above the planar support section a predetermined distance so as to maintains the slideable portion at least 6.35 mm above the horizontal surface of the cabinet.

* * * * *